US006047551A

United States Patent [19]

Ishiguro et al.

[11] Patent Number: 6,047,551

[45] Date of Patent: Apr. 11, 2000

[54] MULTI-NOZZLE COMBUSTOR

[75] Inventors: Tatsuo Ishiguro; Shigemi Mandai; Mitsuru Inada; Satoshi Tanimura; Kouichi Nishida, all of Hyogo-ken, Japan

[73] Assignee: Mitsubishi Heavy Industries, Ltd., Tokyo, Japan

[21] Appl. No.: 09/035,504

[22] Filed: Mar. 5, 1998

[51] Int. Cl.[7] ..... F02C 7/22

[52] U.S. Cl. ..... 60/740; 60/747

[58] Field of Search ..... 60/39.826, 733, 60/740, 741, 746, 747

[56] References Cited

U.S. PATENT DOCUMENTS 5,328,355 7/1994 Kobayashi et al. ..... 60/747

5,415,000 5/1995 Mumford et al. ..... 60/747

5,660,045 8/1997 Ito et al. ..... 60/747

*Primary Examiner*—Louis J. Casaregola

*Attorney, Agent, or Firm*—John P. White; Cooper & Dunham LLP

[57] ABSTRACT

A multi-nozzle combustor comprising a pilot nozzle for flame retention and a plurality of main nozzles arranged around the pilot nozzle, each of the nozzles including an outer cylinder, an inner cylinder, and an annular passage defined between the outer and inner cylinders and forming therein a mixture-evaporation region for a fuel ejected and atomized by an airflow.

7 Claims, 2 Drawing Sheets

MULTI-NOZZLE COMBUSTOR

BACKGROUND OF THE INVENTION

The present invention relates to a multi-nozzle combustor having a pilot nozzle for flame retention in the center and a plurality of main nozzles around the pilot nozzle, and more particularly, to a multi-nozzle combustor suitably used as a gas turbine combustor.

FIG. 1 is a sectional view of a conventional combustor. This combustor comprises a pilot nozzle 3 in its central portion and a cone 4 for flame retention around it. A plurality of main nozzles 1 are arranged in the circumferential direction between the cone 4 and an inner cylinder 5.

Each main nozzle 1 includes a shaft 6 for fuel supply and a nozzle guide 2. FIG. 2 is an enlarged view showing one main nozzle 1 and its surroundings. As shown in FIG. 2, a region for flame propagation from a pilot flame to a main fuel is formed between the flame-retention cone 4 of the pilot nozzle 3 and the inner cylinder 5. In this propagation region, a distribution 12*a* of the fuel ejected from the main nozzle 1 is an uneven distribution, involving a fuel-lean region corresponding to a flow area 11 behind the shaft 6 and a fuel-rich region 12*b* around it.

Since the fuel is ejected at a certain fuel ejection angle 10 to an airflow, as shown in FIG. 2, the distribution 12*a* of the fuel ejected from the main nozzle 1 between the flame-retention cone 4 and the inner cylinder 5 involves a fuel-overrich region.

As shown in FIG. 2, moreover, the length of a mixture-evaporation region 16 from a fuel ejection position to a firing position is so short that a liquid fuel cannot be mixed satisfactorily with air. Accordingly, there exist also microscopic fuel-overrich regions.

When a gas turbine is subject to a high load, furthermore, the fuel concentration has a distribution 12*a* such that it is low in the region around a main nozzle shaft center 7 and higher on the wall side, as shown in FIG. 3A. When the turbine load is low, on the other hand, the fuel concentration has a distribution 12*b* such that it is high in the region around the shaft center 7, as shown in FIG. 3B.

In the fuel nozzle of the conventional combustor, as described above, the use of the fuel supply shaft 6 entails the existence of the fuel-rich region 12*b*.

The gas turbine combustor is subject to the problem of reduction of $NO_X$ in exhaust gas. An $NO_X$ generating region is a region in which the fuel is overrich and its concentration is locally high. Since the fuel distribution of the conventional fuel nozzle is uneven, it involves the fuel-rich region 12*b*, as shown in FIG. 2, so that the delivery of $NO_X$ is substantial.

Further, the fuel distribution varies depending on the load. When the load is high, a flame propagation 14 can be effected smoothly with the main fuel distributed very close to a pilot flame 19, as shown in FIG. 3A. When the load is low, however, the main fuel is distributed at a distance from the pilot flat 19, so that a flame propagation 18 from the pilot flame 19 to the main fuel cannot be effected smoothly, as shown in FIG. 3*b*, and therefore, a combustible is left inevitably.

BRIEF SUMMARY OF THE INVENTION

The object of the present invention is to provide a multi-nozzle combustor having a pilot nozzle for flame retention in the center and a plurality of main nozzles around the pilot nozzle, in which the fuel distribution is uniform despite the change of the fuel flow rate, so that $NO_X$ and combustibles are produced at lower rates.

In order to achieve the above object, a multi-nozzle combustor according to the present invention is designed so that each of its main nozzles is composed of an outer cylinder and an inner cylinder, a fuel is ejected from an annular passage defined between the outer and inner cylinders and atomized by means of an airflow around the ejected fuel, and a mixture-evaporation region is formed thereafter. According to this arrangement, the fuel ejection angle substantially corresponds to the course of the airflow.

In the multi-nozzle combustor of the invention constructed in this manner, the fuel is supplied from the annular passage, so that the fuel distribution in the circumferential direction can be made uniform at the stage of fuel supply.

Since the direction of fuel ejection substantially corresponds to the course of the airflow, moreover, change of dispersion attributable to the change of the fuel flow rate can be reduced.

According to the combustor of the present invention, the fuel ejected from the main nozzles is atomized by means of the airflow, so that the particle size of the fuel can be reduced, and the fuel evaporation region can be provided for the acceleration of mixture after the atomization. Thus, the evaporation is promoted to ensure pre-mixture combustion.

Preferably, in the combustor of the invention, a shaft for fuel supply is provided on the upstream side where the flow rate of air is low. This shaft serves to prevent stagnation of air at the outlet of each nozzle, thereby making the fuel distribution uniform.

Preferably, moreover, the fuel mixture-evaporation region should be lengthened to improve the evaporation characteristics of the fuel.

In the combustor of the invention, furthermore, an air swirler should be provided in the inner cylinder in order to accelerate mixture of the fuel and air.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments give below, serve to explain the principles of the invention.

DETAILED DESCRIPTION OF THE INVENTION

Figure 1:
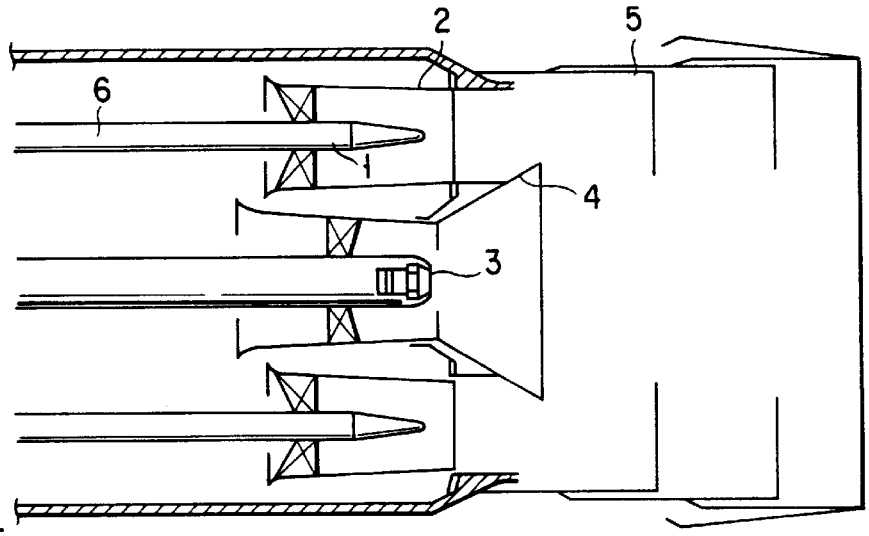
FIG. 1 PRIOR ART
FIG. 1 is a sectional view showing a conventional combustor.
Figure 2:
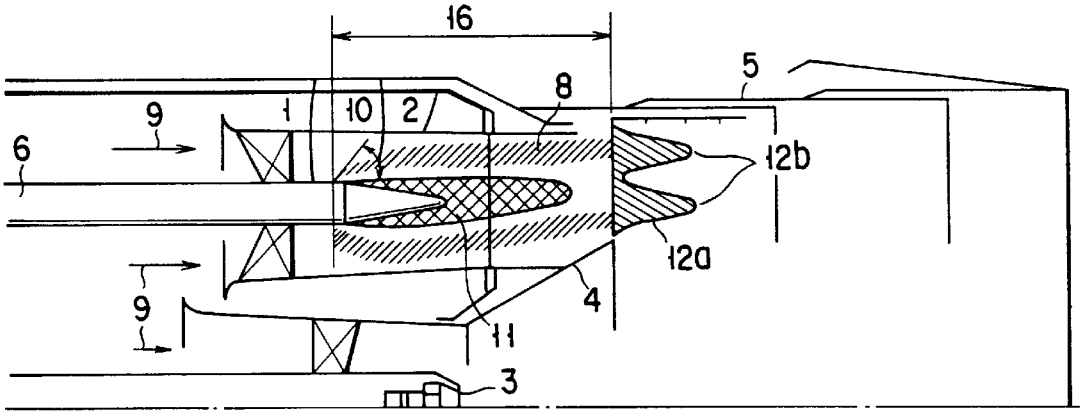
FIG. 2 PRIOR ART
FIG. 2 is a diagram illustrating a fuel distribution in a conventional fuel nozzle.
Figure 3A:
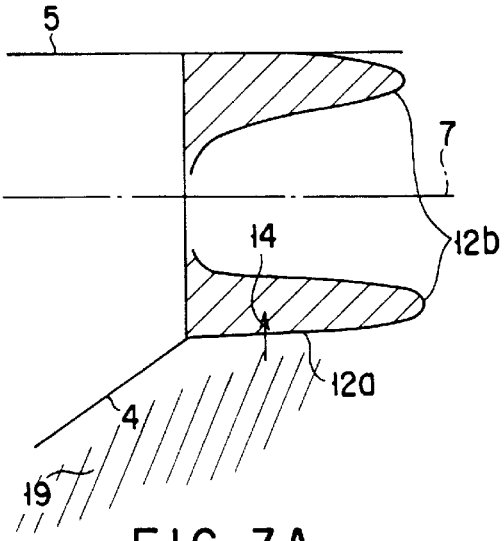
FIG. 3A PRIOR ART
FIGS. 3A and 3B are diagrams illustrating fuel distributions based different loads, high and low, respectively, on the conventional fuel nozzle.
Figure 3B:
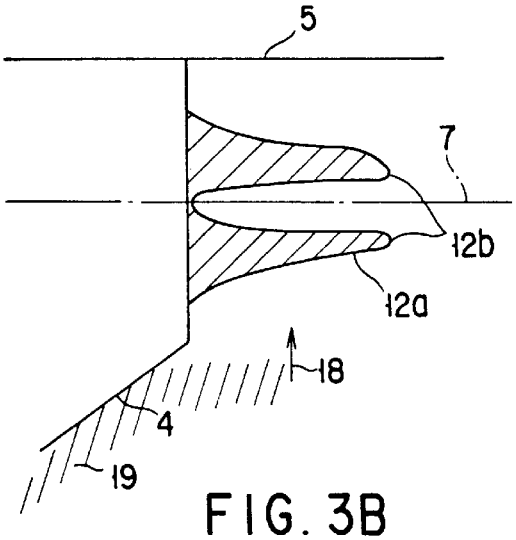
FIG. 3B PRIOR ART
Figure 4:
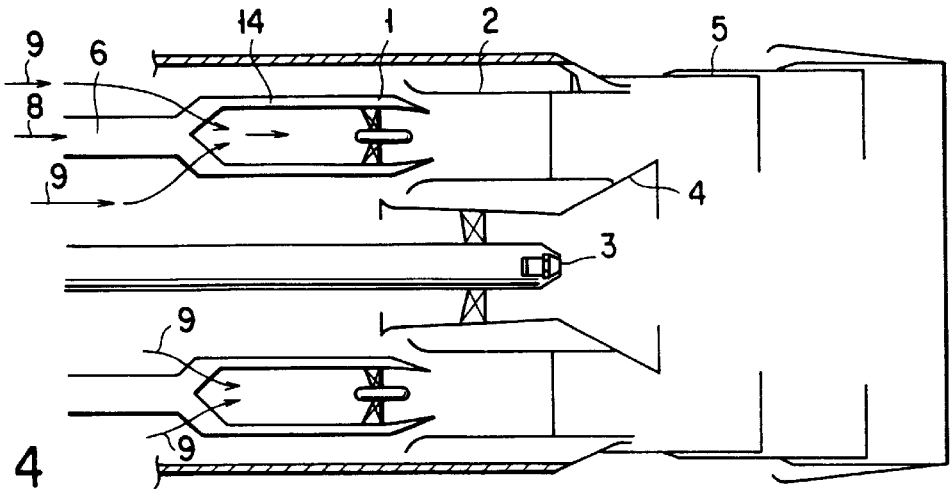
FIG. 4 is a sectional view of a combustor according to an embodiment of the present invention.

A combustor according to an embodiment of the present invention will now be described in detail with reference to the accompanying drawings of FIGS. 4 to 6. In the foregoing description of the prior art and the description to follow, like reference numerals are used to designate like portions throughout the drawings for simplicity of illustration.

The combustor of the present embodiment comprises a pilot nozzle 3 in its central portion and a cone 4 for flame retention around it. A plurality of main nozzles 1 are arranged in the circumferential direction between the cone 4 and an inner cylinder 5.

Each main nozzle 1 includes a shaft 6 for supplying a fuel, a fuel ring 14 for ejecting the fuel, and a nozzle guide 2 that serves as a region in which the fuel is mixed with air and evaporated.

Figure 5A:
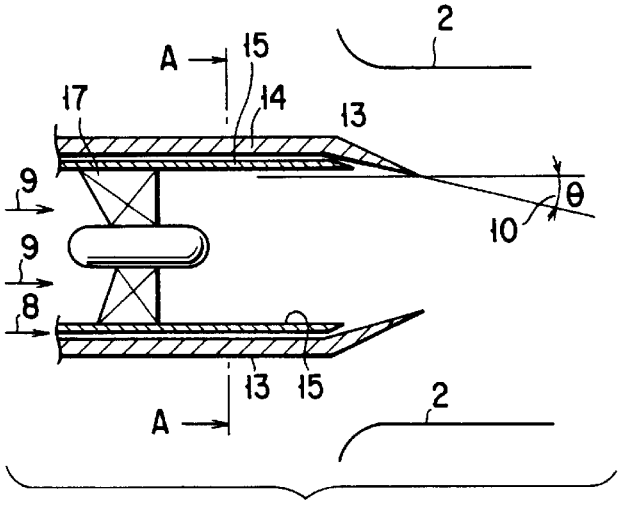
FIGS. 5A and 5B are enlarged sectional views of a fuel nozzle of the combustor shown in FIG. 4.
Figure 5B:
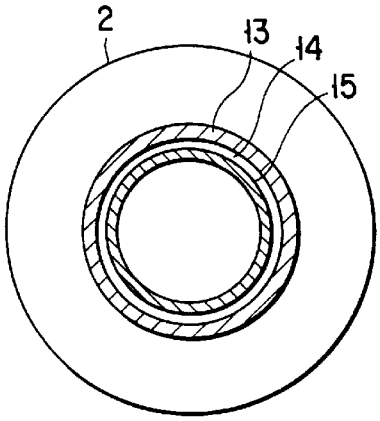

FIGS. 5A and 5B show the details of a nozzle portion of one main nozzle 1. As shown in FIGS. 5A and 5B, a fuel ejecting portion of the nozzle 1 ejects the fuel from the fuel ring 14 that is defined by a gap between a fuel nozzle outer cylinder 13 and a fuel nozzle inner cylinder 15. A fuel ejection angle 10 to the horizontal direction is given by θ. An air swirler 17, which is provided in the inner cylinder 15, is used to apply a turning effort to an airflow, thereby accelerating the mixture of the fuel and air.

Figure 6:
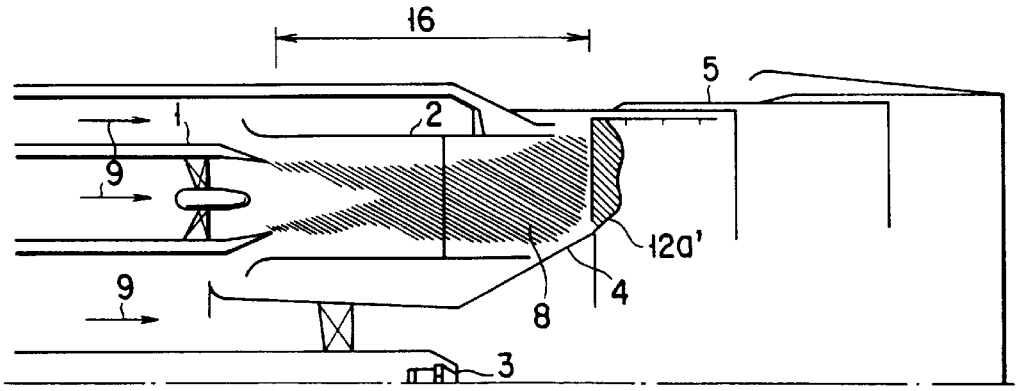
FIG. 6 is a diagram illustrating a fuel distribution in the fuel nozzle of the combustor shown in FIG. 4.

As shown in FIG. 6, the mixture of the fuel and air is accelerated in that area of the nozzle which is surrounded by the cone 4 and the inner cylinder 5. In this region 16, therefore, a fuel distribution 12*a*' is so uniform that no fuel-overrich region exists.

Since the air flows substantially in the same direction as the fuel ejection, moreover, the fuel distribution cannot be one-sided despite fluctuations in gas turbine load.

Since the fuel is atomized by the airflow, furthermore, it can be reduced in particle size, so that its evaporation can be accelerated. Besides, the evaporation of the fuel is further accelerated by extending a mixture-evaporation region 16, so that pre-mixture combustion can be effected even with use of an oil fuel.

It is to be understood that the fuel used in the combustor according to the present invention may be either liquid or gaseous.

In the combustor of the invention, as described above, each main nozzle is composed of the inner and outer cylinders, the fuel is ejected from an annular passage that is formed in the gap between the two cylinders. After the fuel is atomized by the surrounding airflow, the mixture-evaporation region is formed. In this combustor, the fuel and air are mixed satisfactorily, so that a local high-temperature flame cannot be formed with ease. Thus, according to the combustor of the invention, production of $NO_X$ can be restrained to ensure low-$NO_X$ combustion.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A multi-nozzle combustor comprising:

a pilot nozzle for retaining flame; and a plurality of main nozzles arranged around the pilot nozzle, each of said main nozzles including an inner cylinder for ejecting an airflow and an outer cylinder arranged around said inner cylinder and used for forming an annular passage between the outer and inner cylinders, a fuel-flow being ejected from said passage, whereby the ejected fuel-flow is atomized in a downstream region with respect to each of said main nozzles, mixed with the ejected airflow, and evaporated.

2. A multi-nozzle combustor according to claim 1, wherein said inner cylinder has an air swirler therein.

3. A multi-nozzle combustor according to claim 1, wherein said fuel is a liquid fuel.

4. A multi-nozzle combustor according to claim 1, wherein said fuel is a gaseous fuel.

5. A multi-nozzle combustor according to claim 1, wherein an axis of said outer cylinder is arranged substantially parallel to an axis of said inner cylinder, whereby a direction of the fuel-flow ejected from said annular passage is the same as a direction of the airflow ejected from said inner cylinder.

6. A multi-nozzle combustor according to claim 1, wherein each of said main nozzles includes a fuel supply shaft provided on the upstream side where the flow rate of air is low.

7. A multi-nozzle combustor according to claim 1, wherein said downstream region has a length, with respect to an axis of said outer cylinder, corresponding to a difference of a relativistic velocity between the fuel-flow and the ejected airflow.

* * * * *